United States Patent [19]

Chung et al.

[11] 4,412,934

[45] Nov. 1, 1983

[54] BLEACHING COMPOSITIONS

[75] Inventors: Stanley Y. Chung, Cincinnati; Gianfranco L. Spadini, Wyoming, both of Ohio

[73] Assignee: The Procter & Gamble Company, Cincinnati, Ohio

[21] Appl. No.: 472,683

[22] Filed: Mar. 7, 1983

Related U.S. Application Data

[63] Continuation-in-part of Ser. No. 393,843, Jun. 30, 1982, abandoned.

[51] Int. Cl.[3] ..... D06L 3/02; C11D 3/395; C11D 7/54

[52] U.S. Cl. ..... 252/186.38; 252/95; 8/111

[58] Field of Search ..... 252/186.38, 95, 99; 8/111

[56] References Cited

U.S. PATENT DOCUMENTS

| | | | |
|---|---|---|---|
| 4,110,074 | 8/1978 | Finley | 252/186.38 |
| 4,111,651 | 9/1978 | Blumbergs | 252/186.38 |
| 4,115,058 | 9/1978 | Blumbergs | 252/186.38 |
| 4,169,805 | 10/1979 | Blumbergs | 252/186.38 |
| 4,283,301 | 9/1981 | Diehl et al. . | |

FOREIGN PATENT DOCUMENTS

| | | |
|---|---|---|
| 836988 | 6/1960 | United Kingdom . |
| 864798 | 4/1961 | United Kingdom . |

*Primary Examiner*—Irwin Gluck

*Attorney, Agent, or Firm*—Robert V. Aylor; Thomas H. O'Flaherty; Richard C. Witte

[57] ABSTRACT

This invention relates to bleaching compositions that provide effective and efficient surface bleaching of textiles over a wide range of bleach solution temperatures. Surface bleaching of textiles is bleaching wherein the bleaching mechanism takes place on the textile surface and, thereby, removes stains and/or soils. The bleaching compositions within the invention contain peroxygen bleaches capable of yielding hydrogen peroxide in aqueous solutions and specific bleach activators at specific molar ratios of hydrogen peroxide to bleach activator. In a highly preferred embodiment the bleaching compositions within the invention are detergent compositions.

22 Claims, No Drawings

BLEACHING COMPOSITIONS

This is a continuation-in-part of our copending application, Ser. No. 393,843, filed June 30, 1982 now abandoned.

TECHNICAL FIELD

This invention relates to bleaching compositions. More particularly, this invention relates to bleaching compositions that provide effective and efficient surface bleaching of textiles over a wide range of bleach solution temperatures. Surface bleaching of textiles is bleaching wherein the bleaching mechanism takes place on the textile surface and, thereby, removes stains and/or soils. The bleaching compositions within the invention contain peroxygen bleaches capable of yielding hydrogen peroxide in aqueous solutions and specific bleach activators at specific molar ratios of hydrogen peroxide to bleach activator. In a highly preferred embodiment the bleaching compositions within the invention are detergent compositions.

It has long been known that peroxygen bleaches are effective for stain and/or soil removal from textiles, but that they are also extremely temperature dependent. Such bleaches are essentially only practicable and/or effective in bleaching solutions, i.e., a bleach and water mixture, wherein the solution temperature is above about 60° C. At bleach solution temperatures of about 60° C. peroxygen bleaches are only partially effective and, therefore, in order to obtain a desirable level of bleaching performance extremely high levels of peroxygen bleach must be added to the system. This is economically impracticable. As the bleach solution temperature is lowered below 60° C., peroxygen bleaches are rendered ineffective, regardless of the level of peroxygen bleach added to the system. The temperature dependence of peroxygen bleaches is significant because such bleaches are commonly used as a detergent adjuvant in textile wash processes that utilize an automatic household washing machine at wash water temperatures below 60° C. Such wash temperatures are utilized because of textile care and energy considerations. As a consequence of such a wash process, there has been much industrial research to develop substances, generally referred to as bleach activators, that render peroxygen bleaches effective at bleach solution temperatures below 60° C. Numerous substances have been disclosed in the art as effective bleach activators.

BACKGROUND ART

Carboxylic acid ester bleach activators are known. U.K. Pat. No. 864,798, Hampson et al (Apr. 6, 1961), discloses bleaching compositions comprising an inorganic persalt and an organic ester of an aliphatic carboxylic acid wherein the size of the carboxylic acid ester particles are such that at least 70% of them are retained on a 60 mesh British Standard sieve. It is preferred that the ester be derived from an aliphatic carboxylic acid having not more than 10, preferably less than 8 carbon atoms. The proportion of molecules of reactive ester to each atom of available oxygen in the persalt is from $\frac{1}{4}$ to 4 and preferably from $\frac{1}{2}$ to 1.5. It is stated that such bleaching compositions are stable during storage.

U.K. Pat. No. 836,988, Davies et al (June 9, 1960), discloses bleaching compositions containing hydrogen peroxide or inorganic persalt and organic carboxylic esters. A test is described to define the esters within the invention. The molecules of ester per one atom of available oxygen are from $\frac{1}{4}$ to 2 and particularly from $\frac{1}{2}$ to 1.5. It is stated that such esters provide improved bleaching at temperatures from 50° C. to 60° C. relative to that obtained with the persalt alone.

It is also known that the bleach activators that are believed to exhibit surface activity that are utilized in combination with peroxygen bleaches provide particularly effective surface bleaching. U.S. Pat. No. 4,283,301, Diehl (Aug. 11, 1981), discloses bleaching compositions comprising a peroxygen bleach and a bleach activator of the general formula:

$$R-\overset{\overset{\displaystyle O}{\|}}{C}-Z \text{ or } Z-\overset{\overset{\displaystyle O}{\|}}{C}-R^2-\overset{\overset{\displaystyle O}{\|}}{C}-Z$$

wherein R is an alkyl chain containing from about 5 to about 13 carbon atoms, $R^2$ is an alkyl chain containing from about 4 to about 24 carbon atoms and each Z is a leaving group as defined therein. It is preferred that such bleaches and bleach activators are present in equimolar ratios.

SUMMARY OF THE INVENTION

The present invention comprises a bleaching composition containing:

(a) a peroxygen bleaching compound capable of yielding hydrogen peroxide in an aqueous solution; and (b) a bleach activator having the general formula:

$$R-\overset{\overset{\displaystyle O}{\|}}{C}-L$$

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 6 to about 13;

wherein the molar ratio of hydrogen peroxide yielded by (a) to bleach activator (b) is greater than about 1.5.

DETAILED DESCRIPTION OF THE INVENTION

This invention relates to bleaching compositions containing peroxygen bleaches capable of yielding hydrogen peroxide in an aqueous solution and specific bleach activators, hereinafter defined, at specific molar ratios of hydrogen peroxide to bleach activator. Such compositions provide extremely effective and efficient surface bleaching of textiles which thereby remove stains and/or soils from the textiles. The compositions are particularly effective at removing dingy soils from textiles. Dingy soils are soils that build up on textiles after numerous cycles of usage and washing and, thus, result in a white textile having a gray tint. These soils tend to be a blend of particulate and greasy materials. The removal of this type of soil is sometimes referred to as "dingy fabric clean up".

The bleaching compositions provide such bleaching over a wide range of bleach solution temperatures. Such bleaching is obtained in bleach solutions wherein the solution temperature is at least about 5° C. Without the bleach activator such peroxygen bleaches would be ineffective and/or impracticable at temperatures below about 60° C.

The bleaching compositions within the invention are extremely difficult. Much lower levels of the bleach activators within the invention are required, on a molar basis, to achieve the same level of surface bleaching performance that is obtained with similar bleach activators containing only from about 2 to about 5 carbon atoms in the longest linear alkyl chain extending from and including the carbonyl carbon. Without being bound by theory, it is believed that such efficiency is achieved because the bleach activators within the invention exhibit surface activity. This can be explained as follows.

The bleaching mechanism generally, and the surface bleaching mechanism in particular, are not completely understood. However, it is generally believed that the bleach activator undergoes nucleophilic attack by a perhydroxide anion, which is generated from the hydrogen peroxide evolved by the peroxygen bleach, to form a percarboxylic acid. This reaction is commonly referred to as perhydrolysis. The percarboxylic acid then forms a reactive dimer with its anion which, in turn, evolves a singlet oxygen which is believed to be the active bleaching component. It is theorized that the singlet oxygen must be evolved at or near the textile surface in order to provide surface bleaching. Otherwise, the singlet oxygen will provide bleaching, but not at the textile surface. Such bleaching is known as solution bleaching, i.e., the bleaching of soils in the bleach solution.

To ensure that the singlet oxygen is more efficiently evolved at the textile surface, it is essential that the longest linear alkyl chain extending from and including the carbonyl carbon of the percarboxylic acid have from about 6 to about 10 carbon atoms. Such percarboxylic acids are surface active and, therefore, tend to be concentrated at the textile surface. Percarboxylic acids containing fewer carbon atoms in such alkyl chain have similar redox potentials, but do not have the ability to concentrate at the textile surface. Therefore, the bleach activators within the invention are extremely efficient because much lower levels, on a molar basis, of such bleach activators are required to get the same level of surface bleaching performance as with similar bleach activators containing fewer carbon atoms in such an alkyl chain, which are not within the invention.

It is also believed, based upon the same theory as outlined directly above, that the bleach activators within the invention can render peroxygen bleaches more efficient even at bleach solution temperatures wherein bleach activators are not necessary to activate the bleach, i.e., above about 60° C. Therefore, with bleach compositions of the invention, less peroxygen bleach is required to get the same level of surface bleaching performance as is obtained with the peroxygen bleach alone.

The molar ratio of hydrogen peroxide yielded by the peroxygen bleach to bleach activator is critical to obtaining the desired level of surface bleaching performance. To obtain such performance it is essential that such molar ratio be greater than about 1.5 and preferably at least about 2.0. Surprisingly, increasing such molar ratio above 1.5 results in not only faster formation of the percarboxylic acid, but, most importantly, more percarboxylic acid being formed. With a molar ratio of such components of about 1.5 or less there is a competing chemical reaction that is favored. The percarboxylic acid that is formed further reacts with the unreacted bleach activator to form a diacyl peroxide. It is believed that such competing chemical reaction is favored because of the hydrophobic-hydrophobic interaction of the alkyl chain of the acyl group of the percarboxylic acid and the unreacted bleach activator. Consequently, lower concentrations of percarboxylic acid are ultimately achieved and, therefore, bleaching performance is quite poor. Such competing chemical reaction is minimized by the addition of more peroxygen bleach. Accordingly, surface bleaching performance is enhanced, especially on dingy fabrics.

Bleach activators similar to those within the invention but which are outside the invention because their longest linear alkyl chain extending from and including the carbonyl carbon is shorter, i.e., $C_{2-5}$, or longer; i.e., above $C_{11}$, do not form significantly more percarboxylic acid upon increasing the molar ratio of hydrogen peroxide yielded by the peroxygen bleach to bleach activator above 1.5. Experimental evidence with such bleach activators with a shorter alkyl chain shows that molar ratios of hydrogen peroxide yielded by the peroxygen bleach to bleach activator of 1 produce essentially the theoretical maximum of percarboxylic acid, i.e., the percarboxylic acid formed does not further react with unreacted bleach activator. Therefore, the addition of more peroxygen bleach would provide no additional percarboxylic acid. Experimental evidence with such bleach activators with a longer alkyl chain indicates that regardless of how much peroxygen bleach is added insignificant levels of percarboxylic acid are ultimately formed. It is believed that such bleach activators are too hydrophobic and, therefore, regardless of the level of peroxygen bleach, primarily the percarboxylic acid reacts with the unreacted bleach activator to form the diacyl peroxide. Only the bleach activators within the invention are beneficially affected by molar ratios of hydrogen peroxide yielded by the peroxygen bleach to bleach activator greater than about 1.5.

There is essentially no upper limit to such molar ratio because the addition of more peroxygen bleach is not detrimental to the system. However, at ratios above about 10 essentially all of the theoretical amount of percarboxylic acid that can be formed is formed. It is not economically practicable or desirable to add more peroxygen bleach. However, if one is bleaching at bleach solution temperatures wherein a bleach activator is not required to activate the peroxygen bleach, i.e., above 60° C., then more peroxygen bleach can be added and it does provide an additional benefit. This is particularly true under European wash conditions that utilize a "boil wash". Also, it is common for European detergent compositions to contain extremely high levels of peroxygen bleach. Based upon this, the upper limit of the molar ratio of hydrogen peroxide yielded by the peroxygen bleach to bleach activator is about 500.

It should be noted that such ratio can generally be expressed as the molar ratio of peroxygen bleach to bleach activator because the vast majority of peroxygen bleaches yield one mole of hydrogen peroxide per mole of peroxygen bleach.

Optimum surface bleaching performance is obtained with bleaching solutions wherein the pH of such solution is between about 8.5 and 10.5 and preferably between 9 and 10. It is preferred that such pH be greater than 9 not only to optimize surface bleaching performance, but also to prevent the bleaching solution from having an undesirable odor. It has been observed that once the pH of the bleaching solution drops below 9, the bleaching solution has an undesirable odor. Such pH can be obtained with substances commonly known as buffering agents, which are optional components of the bleaching compositions herein.

The following is a detailed description of the essential and the optional components of the bleaching compositions within the invention. All percentages, parts and ratios are by weight unless otherwise indicated.

THE PEROXYGEN BLEACHING COMPOUND

The peroxygen bleaching compounds useful herein are those capable of yielding hydrogen peroxide in an aqueous solution. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono- and tetra-hydrate, sodium carbonate peroxyhydrate, sodium pyrophosphate peroxyhydrate, urea peroxyhydrate, and sodium peroxide. Particularly preferred are sodium perborate tetrahydrate and, especially, sodium perborate monohydrate. Sodium perborate monohydrate is especially preferred because it is very stable during storage and yet still dissolves very quickly in the bleaching solution. It is believed that such rapid dissolution results in the formation of higher levels of percarboxylic acid and, thus, enhanced surface bleaching performance.

The level of peroxygen bleach within compositions of the invention is from about 0.1% to about 95% and preferably from about 1% to about 60%. When the bleaching compositions within the invention are also detergent compositions it is preferred that the level of peroxygen bleach is from about 1% to about 20%.

THE BLEACH ACTIVATOR

The bleach activators within the invention have the general formula:

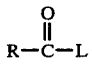

Wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 6 to about 13.

L can be essentially any suitable leaving group. A leaving group is any group that is displaced from the bleach activator as a consequence of the nucleophilic attack on the bleach activator by the perhydroxide anion. This, the perhydrolysis reaction, results in the formation of the percarboxylic acid. Generally, for a group to be a suitable leaving group it must exert an electron attracting effect. This facilitates the nucleophilic attack by the perhydroxide anion. Leaving groups that exhibit such behavior are those in which their conjugate acid has a $pK_a$ in the range of from about 6 to about 13, preferably from about 7 to about 11 and most preferably from about 8 to about 11.

Preferred bleach activators are those of the above general formula wherein R is as defined in the general formula and L is selected from the group consisting of:

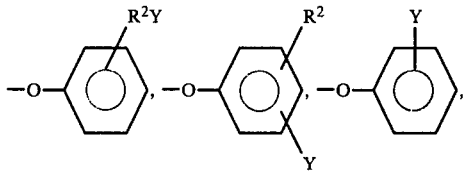

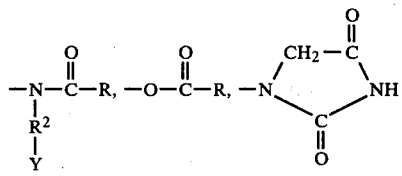

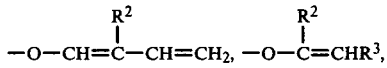

wherein R is as defined above, $R^2$ is an alkyl chain containing from about 1 to about 8 carbon atoms, $R^3$ is H or $R^2$, and Y is H or a solubilizing group. The preferred solubilizing groups are $—SO^-{}_3M^+$, $—COO^-M^+$, $—SO^-{}_4M^+$, $(—N^+R_3{}^4)X^-$ and $O←NR_2{}^4$ and most preferably $—SO^-{}_3M^+$ and $—COO^-M^+$ wherein $R^4$ is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing group should be well dispersed in the bleaching solution in order to assist in their dissolution.

Preferred bleach activators are also those of the above general formula wherein L is as defined in the general formula and R is an alkyl group containing from about 5 to about 12 carbon atoms wherein the longest linear alkyl chain extending from and including the carbonyl carbon contains from about 6 to about 10 carbon atoms.

Even more preferred are bleach activators of the above general formula wherein L is as defined in the general formula and R is a linear alkyl chain containing from about 5 to about 9 and preferably from about 6 to about 8 carbon atoms.

More preferred bleach activators are those of the above general formula wherein R is a linear alkyl chain containing from about 5 to about 9 and preferably from about 6 to about 8 carbon atoms and L is selected from the group consisting of:

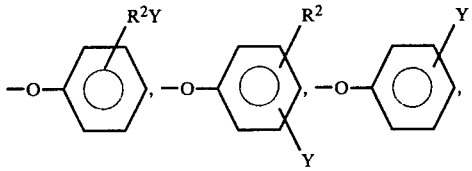

-continued

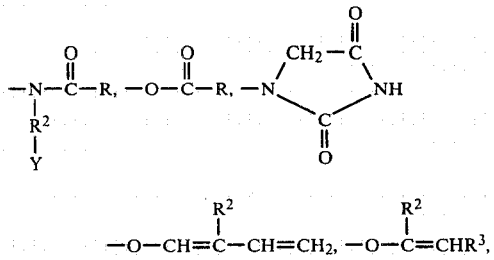

wherein R, $R^2$, $R^3$ and Y are as defined above.

Particularly preferred bleach activators are those of the above general formula wherein R is an alkyl group containing from about 5 to about 12 carbon atoms wherein the longest linear portion of the alkyl chain extending from and including the carbonyl carbon is from about 6 to about 10 carbon atoms and L is selected from the group consisting of:

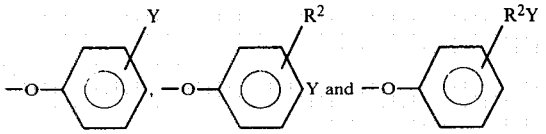

wherein $R^2$ is as defined above and Y is $—SO^-{}_3M^+$ or $—COO^-M^+$ wherein M is as defined above.

Especially preferred bleach activators are those of the above general formula wherein R is a linear alkyl chain containing from about 5 to about 9 and preferably from about 6 to about 8 carbon atoms and L is selected from the group consisting of:

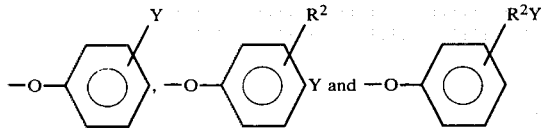

wherein $R^2$ is as defined above and Y is $—SO^-{}_3M^+$ or $—COO^-M^+$ wherein M is as defined above.

The most preferred bleach activators have the formula:

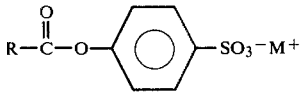

wherein R is a linear alkyl chain containing from about 5 to about 9 and preferably from about 6 to about 8 carbon atoms and M is sodium or potassium.

The level of bleach activator within the compositions of the invention is from about 0.1% to about 60% and preferably from about 0.5% to about 40%. When the bleaching compositions within the invention are also detergent compositions it is preferred that the level of bleach activator is from about 0.5% to about 20%.

OPTIONAL COMPONENTS

As a preferred embodiment, the bleaching compositions of the invention can be detergent compositions. Thus, the bleaching compositions can contain typical detergent composition components such as detergency surfactants and detergency builders. In such preferred embodiments the bleaching compositions are particularly effective. The bleaching compositions of this invention can contain all of the usual components of detergent compositions including the ingredients set forth in U.S. Pat. No. 3,936,537, Baskerville et al, incorporated herein by reference. Such components include color speckles, suds boosters, suds suppressors, antitarnish and/or anticorrosion agents, soil-suspending agents, soil-release agents, dyes, fillers, optical brighteners, germicides, alkalinity sources, hydrotropes, antioxidants, enzymes, enzyme stabilizing agents, perfumes, etc.

The detergent surfactants can be any one or more surface active agents selected from anionic, nonionic, zwitterionic, amphoteric and cationic classes and compatible mixtures thereof. Detergent surfactants useful herein are listed in U.S. Pat. No. 3,664,961, Norris, issued May 23, 1972, and in U.S. Pat. No. 3,919,678, Laughlin et al, issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference. The following are representative examples of detergent surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups). Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Preferred nonionics are the water-soluble and water-dispersible condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

The level of detergent surfactant that can be employed is from 0% to about 50%, preferably from about 1% to about 30% and most preferably from about 10% to about 25% by weight of the total composition.

In addition to detergent surfactants, detergency builders can be employed in the bleaching compositions. Water-soluble inorganic or organic electrolytes are suitable builders. The builder can also be water-insoluble calcium ion exchange materials; nonlimiting examples of suitable water-soluble, inorganic detergent builders include: alkali metal carbonates, borates, phosphates, bicarbonates and silicates. Specific examples of such salts include sodium and potassium tetraborates, bicarbonates, carbonates, orthophosphates, pyrophosphates, tripolyphosphates and metaphosphates.

Examples of suitable organic alkaline detergency builders include: (1) water-soluble amino carboxylates and aminopolyacetates, for example, nitrilotriacetates, glycinates, ethylenediamine, tetraacetates, N-(2-hydroxyethyl)nitrilo diacetates and diethylenetriamine pentaacetates; (2) water-soluble salts of phytic acid, for example, sodium and potassium phytates; (3) water-soluble polyphosphonates, including sodium, potassium, and lithium salts of ethane-1-hydroxy-1, 1-diphosphonic acid; sodium, potassium, and lithium salts of ethylene diphosphonic acid; and the like; (4) water-soluble polycarboxylates such as the salts of lactic acid, succinic acid, malonic acid, maleic acid, citric acid, carboxymethyloxysuccinic acid, 2-oxa-1,1,3-propane tricarboxylic acid, 1,1,2,2-ethane tetracarboxylic acid, mellitic acid and pyromellitic acid; and (5) water-soluble polyacetals as disclosed in U.S. Pat. Nos. 4,144,266 and 4,246,495 incorporated herein by reference.

Another type of detergency builder material useful in the present compositions comprises a water-soluble material capable of forming a water-insoluble reaction product with water hardness cations preferably in combination with a crystallization seed which is capable of providing growth sites for said reaction product. Such "seeded builder" compositions are fully disclosed in British Pat. No. 1,424,406.

A further class of detergency builder materials useful in the present invention are insoluble sodium aluminosilicates, particularly those described in Belgian Pat. No. 814,874, issued Nov. 12, 1974, incorporated herein by reference. This patent discloses and claims detergent compositions containing sodium aluminosilicates having the formula:

$$Na_z(AlO_2)_z(SiO_2)_yXH_2O$$

wherein z and y are integers equal to at least 6, the molar ratio of z to y is in the range of from 1.0:1 to about 0.5:1, and X is an integer from about 15 to about 264, said aluminosilicates having a calcium ion exchange capacity of at least 200 milligrams equivalent/gram and a calcium ion exchange rate of at least about 2 grains/gallon/minute/gram. A preferred material is Zeolite A which is:

$$Na_{12}(SiO_2AlO_2)_{12}27H_2O$$

The level of detergency builder of the bleaching compositions is from 0% to about 70%, preferably from about 10% to about 60% and most preferably from about 20% to about 60%.

Buffering agents can be utilized to maintain the desired alkaline pH of the bleaching solutions. Buffering agents include, but are not limited to many of the detergency builder compounds disclosed hereinbefore. Buffering agents suitable for use herein are those well known in the detergency art.

Preferred optional ingredients include suds modifiers particularly those of suds suppressing types, exemplified by silicones, and silica-silicone mixtures.

U.S. Pat. Nos. 3,933,672, issued Jan. 20, 1976 to Bartolotta et al, and 4,136,045, issued Jan. 23, 1979 to Gault et al, incorporated herein by reference, disclose silicone suds controlling agents. The silicone material can be represented by alkylated polysiloxane materials such as silica aerogels and xerogels and hydrophobic silicas of various types. The silicone material can be described as siloxane having the formula:

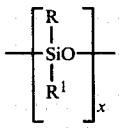

wherein x is from about 20 to about 2,000 and R and $R^1$ are each alkyl or aryl groups, especially methyl, ethyl, propyl, butyl and phenyl. The polydimethylsiloxanes (R and $R^1$ are methyl) having a molecular weight within the range of from about 200 to about 2,000,000, and higher, are all useful as suds controlling agents. Additional suitable silicone materials wherein the side chain groups R and $R^1$ are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpoly-siloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. Pat. No. 4,073,118, Gault et al, issued Feb. 21, 1978, incorporated herein by reference. An example of such a compound is DB-544, commercially available from Dow Corning, which is a siloxane/glycol copolymer.

Suds modifiers as described above are used at levels of up to approximately 2%, preferably from about 0.1 to about 1-½% by weight of the surfactant.

Microcrystalline waxes having a melting point in the range from 35° C.–115° C. and a saponification value of less than 100 represent additional examples of preferred suds control components for use in the subject compositions, and are described in detail in U.S. Pat. No. 4,056,481, Tate, issued Nov. 1, 1977, incorporated herein by reference. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 77° F. by ASTM-D1321. Suitable examples of the above waxes include: microcrystalline and oxidized microcrystalline petroleum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds control agent for use herein. These preferred phosphate esters are predominantly monostearyl phosphate which, in addition thereto, can contain di- and tristearyl phosphates and monooleyl phosphate, which can contain di- and trioleyl phosphate.

Other suds control agents useful in the practice of the invention are the soap or the soap and nonionic mixtures as disclosed in U.S. Pat. Nos. 2,954,347 and 2,954,348, incorporated herein by reference.

The following examples are given to illustrate the parameters of and compositions within the invention. All percentages, parts and ratios are by weight unless otherwise indicated.

EXAMPLE I

The following granular detergent compositions are prepared:

| | % |
|---|---|
| Sodium $C_{14-15}$ alkyl sulfate | 10.1 |
| Sodium $C_{13}$ linear alkylbenzene sulfonate | 6.7 |
| $C_{9-11}$ alkyl polyethoxylate$_{2.5T}$* | 1.5 |
| $C_{12}$ alkyltrimethyl ammonium chloride | 3.1 |
| Sodium tripolyphosphate | 36.0 |
| Sodium nitrilotriacetate | 3.9 |
| Sodium carbonate | 17.0 |
| Sodium sulfate | 10.1 |
| Sodium silicate (1.6r) | 1.8 |
| Water | 8.1 |
| Miscellaneous (e.g., perfume, optical brightener. etc.) | 1.8 |

*Stripped of lower ethoxylated fractions and fatty alcohol.

Ten sets of six 5"×5" swatches consisting of standard textiles and five sets of four terry cloth towels were preconditioned by adding artificial body soils to them so as to simulate the condition of household laundry that has been subjected to routine wear. Each set of six swatches was then stained with a different bleachable stain. The swatches were then cut in half to produce 20 sets of half swatches with half of the stain being on each half of the swatch. One terry cloth towel from each set of terry cloth towels was then soiled with a mixture of artificial body soil and vacuum cleaner soil.

A laundry load consisting of one of the sets of terry cloth towels and four of the sets of half swatches was placed in each of five mini-wash systems. The four sets of half swatches placed in each mini-wash system were chosen so that no half swatch was placed in the same mini-wash system as its original other half.

The laundry load in the first mini-wash system was washed with a quantity of the above detergent composition that corresponds to 1250 ppm in the wash water which is typical of conventional automatic wash processes. The mini-wash system with such a load simulates a conventional automatic wash process. The wash water temperature was 37° C. and the rinse water temperature was 22° C. and both contained 7 grains/gallon water hardness.

This wash process was carried out in the other four mini-wash systems, but with each mini-wash system containing a bleaching composition consisting of the above detergent compositions plus one of the following bleaching systems:

| A | B |
|---|---|
| Sodium perborate<br>Sodium acetyloxybenzene sulfonate | Sodium perborate<br>Sodium linear hexanoyloxybenzene sulfonate |
| **C** | **D** |
| Sodium perborate<br>Sodium linear octanoyloxybenzene sulfonate | Sodium perborate<br>Sodium linear decanoyloxybenzene sulfonate |

For each of these bleaching systems the molar ratio of hydrogen peroxide yielded by sodium perborate to bleach activator was 3 and the quantity of bleach activator added to the wash water corresponded to a maximum theoretical amount of available oxygen from percarboxylic acid of 6 parts per million (ppm).

Each of the swatches was then comparison graded with its original other half to determine relative stain removal. A grading scale of −4 to 4 was used, with −4 indicating much less stain removal, 0 indicating no difference and 4 indicating much more stain removal. The average of the grades for each stain of each mini-wash system was calculated.

The entire above procedure was repeated. The average of the two determinations of each of the above described averages was calculated. Finally, the average of all such averages for each mini-wash system was calculated. The average for each system was then scaled from 0 to 100, with 0 being the mini-wash system that provided the least stain removal and 100 being the mini-wash system that provided the most stain removal. This number is known as the Bleaching Index.

The results were as follows:

| | A | B | C | D | No Bleach |
|---|---|---|---|---|---|
| Bleaching Index | 19 | 52 | 100 | 91 | 0 |
| Least Significant Difference (.05) | 20 | 20 | 20 | 20 | 20 |

Bleaching compositions containing bleaching systems B, C, and D provided significantly more stain removal than the bleaching composition containing bleaching system A, which contains a bleach activator outside the invention.

EXAMPLE II

The bleaching composition consisting of the detergent composition of Example I plus the bleaching system consisting of the sodium perborate and the sodium acetyloxybenzene sulfonate was placed in a beaker of water. The amount of detergent composition and bleach activator added to the beaker of water corresponded to 1250 ppm and a maximum theoretical amount of available oxygen from percarboxylic acid of 10 ppm, respectively. The molar ratio of hydrogen peroxide yielded by sodium perborate to sodium acetyloxybenzene sulfonate was 1. The water in the beaker was 37° C. and contained 7 grains/gallon water hardness.

The amount of available oxygen from percarboxylic acid was measured, utilizing an iodometric titration procedure, 5, 10 and then 15 minutes after the bleaching composition was placed in the beaker. These three measurements were averaged and then the percent conversion of the sodium acetyloxybenzene sulfonate to percarboxylic acid was calculated.

The above procedure was repeated numerous times, but with varying the acyl group on the bleach activator and molar ratios of hydrogen peroxide yielded by sodium perborate to bleach activator by adjusting the level of sodium perborate. The acyl group was as indicated.

The results were as follows:

| | % Conversion of Bleach Activator to Percarboxylic Acid | | | | |
|---|---|---|---|---|---|
| | 1:1 | 2:1 | 3:1 | 4:1 | 15:1 |
| Bleach Activator | | | | | |
| I. Acetyl | 95 | — | 95 | — | — |
| II. Linear hexanoyl | 85 | — | 92 | — | — |
| III. Linear heptanoyl | 60 | 70 | 98 | — | — |
| IV. Linear octanoyl | 50 | 70 | 83 | 90 | — |
| V. Linear decanoyl | 40 | — | 58 | — | — |
| VI. Dodecanoyl | 2 | — | 4 | — | 0 |

Increasing the molar ratio of hydrogen peroxide yielded by sodium perborate to bleach activator above 1 with bleaching compositions containing bleach activators I and V, which are outside the invention, produces essentially no additional percarboxylic acid. Even with such a ratio of 15, the bleaching composition containing bleach activator V produces essentially no percarboxylic acid. Increasing such molar ratio above 1 with bleaching compositions containing bleach activators II, III and IV, which are within the invention, produces significantly more percarboxylic acid.

EXAMPLE III

The following granular detergent compositions were prepared:

| | A % | B % |
|---|---|---|
| Sodium $C_{16-18}$ alkyl sulfate | 5.5 | 0 |
| Sodium $C_{12}$ linear alkylbenzene sulfonate | 3.5 | 0 |
| Sodium $C_{13}$ linear alkylbenzene sulfonate | 0 | 7.1 |
| Sodium $C_{14-15}$ alkyl sulfate | 0 | 10.7 |
| $C_{14-16}$ alkyl polyethoxylate$_{2.25}$ | 5.5 | 0 |
| $C_{12}$ alkyl trimethyl ammonium chloride | 0 | 3.2 |
| $C_{9-11}$ alkyl polyethoxylate$_{2.5T}$ | 0 | 1.6 |
| Sodium tripolyphosphate | 24.4 | 38.0 |
| Sodium nitrilotriacetate | 0 | 4.1 |
| Zeolite A | 17.6 | 0 |
| Sodium carbonate | 10.5 | 12.0 |
| Sodium silicate (2.0r) | 1.9 | 0 |
| Sodium silicate (1.6r) | 0 | 1.9 |
| Sodium sulfate | 21.0 | 10.7 |
| Water | 8.9 | 8.5 |
| Miscellaneous | 1.2 | 1.8 |

A bleaching system consisting of sodium perborate and sodium linear octanoyloxybenzene sulfonate was prepared.

The stain removal capabilities of bleaching compositions consisting of such bleaching system plus detergent compositions A and B was determined by the same procedure as in Example I. The molar ratio of hydrogen peroxide yielded by sodium perborate to sodium linear octanoyloxybenzene sulfonate was 3 and the quantity of bleach activator added to the wash water corresponded to a maximum theoretical amount of available oxygen from percarboxylic acid of 4.5 ppm.

The results were as follows:

| | A | B | A + Bleach | B + Bleach |
|---|---|---|---|---|
| Bleaching Index | 0 | 10 | 100 | 91 |
| Least Significant Difference (.05) | 33 | 33 | 33 | 33 |

Bleaching compositions A+bleach and B+bleach, which are within the invention, provided significantly more stain removal than the detergent compositions A and B.

EXAMPLE IV

Four dingy T-shirts were cut in half. Four of the half T-shirts, none of which was its original other half, and a 7.5 pound soiled household laundry load were placed in a conventional automatic washing machine. These textiles were then washed with the bleaching composition containing a quantity of the granular detergent composition of Example I that corresponds to concentrations utilized in a conventional automatic wash process and the bleaching system consisting of sodium perborate and sodium linear octanoyloxybenzene sulfonate. The molar ratio of hydrogen peroxide yielded by sodium perborate to sodium linear octanoyloxybenzene sulfonate was 1 and the quantity of the bleaching system added to the wash water corresponded to a maximum theoretical amount of oxygen from percarboxylic acid of 4.5 ppm. The wash water temperature was 37° C. and contained 5 grains/gallon water hardness.

The above procedure was repeated with the remaining four half T-shirts and without the bleaching system; i.e., just the detergent composition.

Each half T-shirt was then comparison graded with its original other half to determine relative dingy fabric clean up. The grading scale of −4 to 4, as described in Example I, was utilized. The average of the four grades for each wash system was calculated.

The entire above procedure was repeated three more times and the average of the above described average for each wash system was calculated.

This procedure was repeated numerous times to compare the above bleaching composition to bleaching compositions containing the same components, but different molar ratios of hydrogen peroxide yielded by sodium perborate to sodium linear octanoyloxybenzene sulfonate. Such molar ratio was varied by changing the level of sodium perborate. The average for each wash system was then scaled from 0 to 100, with 0 being the wash system that provided the least dingy fabric clean up and 100 being the wash system that provided the most dingy fabric clean up. This number is known as the Bleaching Index.

The results were as follows:

| Molar Ratio of Hydrogen Peroxide Yielded by Sodium Perborate to Sodium Linear Octanoyloxybenzene Sulfonate | Bleaching Index | Least Significant Difference (.05) |
|---|---|---|
| Detergent Composition Only | 0 | 20 |
| 1.0 | 38 | 20 |
| 1.5 | 29 | 20 |
| 2.0 | 65 | 20 |
| 3.0 | 100 | 20 |
| 4.0 | 82 | 20 |

Bleaching compositions containing a molar ratio of hydrogen peroxide yielded by sodium perborate to sodium liner octanoyloxybenzene sulfonate of greater than 1.5, which are within the invention, provided significantly more dingy fabric clean up than bleaching compositions with such a molar ratio of 1.5 or less.

EXAMPLE V

A bleaching composition consisting of the detergent composition of Example I and the bleaching system consisting of tetracetylethylenediamine (TAED) and sodium perborate was prepared. TAED is a well known bleach activator in the bleaching composition art. The molar ratio of hydrogen peroxide yielded by sodium perborate to TAED was 3.

Stain removal capabilities of the above bleaching composition were compared to that of the above detergent composition alone by the same procedure as described in Example I. The quantity of bleach activator added to the wash water corresponded to a maximum theoretical amount of oxygen from percarboxylic acid of 3 ppm.

The above procedure was repeated to compare the stain removal capabilities of the above detergent composition to the bleaching composition consisting of the above detergent composition plus the bleaching system consisting of sodium perborate and sodium linear octanoyloxybenzene sulfonate. The molar ratio of hydrogen peroxide yielded by sodium perborate to sodium linear octanoyloxybenzene sulfonate was 3 and the quantity of the bleaching system added to the wash water corresponded to a maximum theoretical amount of oxygen from percarboxylic acid of 3 ppm.

The results were as follows:

| Bleach Activator | Bleaching Index | Least Significant Difference (.05) |
|---|---|---|
| No bleach | 0 | 33 |
| TAED | 33 | 33 |
| Sodium linear octanoyloxybenzene sulfonate | 100 | 33 |

The bleaching composition containing sodium linear octanoyloxybenzene sulfonate provided significantly more stain removal than the bleaching composition containing TAED. When sodium linear heptanoyloxybenzene sulfonate is substituted for the sodium linear octanoyloxybenzene sulfonate, even better performance is possible.

EXAMPLE VI

The following is a granular laundry detergent composition.

| | % |
|---|---|
| Sodium $C_{13}$ alkylbenzene sulfonate | 7.5 |
| Sodium $C_{14-15}$ alkylsulfate | 7.5 |
| $C_{12-13}$ alkyl polyethoxylate (6.5) stripped of unethoxylated alcohol and lower ethoxylate | 2.0 |

-continued

| | % |
|---|---|
| $C_{12}$ alkyltrimethyl ammonium chloride | 1.0 |
| Sodium tripolyphosphate | 32 |
| Sodium carbonate | 10 |
| Sodium perborate monohydrate | 5.3 |
| Sodium octanoyloxybenzene sulfonate | 5.8 |
| Sodium diethylene triamine pentaacetate | 0.5 |
| Sodium sulfate, $H_2O$ and minors | Balance |

When in the above formula the following materials are substituted for the sodium diethylene triamine pentaacetate, substantially equivalent results are obtained in that the interference of heavy metal ions with the bleaching action is substantially reduced: sodium or potassium ethylenediamine tetracetate; N,N-di-(2-hydroxyethyl) glycine; ethylenediaminetetra(methylenephosphonate); hexamethylene diaminetetra(methylenephosphonate); diethylenetriaminepenta(methylenephosphonate); and 1:1 mixtures thereof.

What is claimed is:

1. A bleaching composition comprising:

(a) a peroxygen bleaching compound capable of yielding hydrogen peroxide in an aqueous solution; and (b) a bleach activator having the general formula:

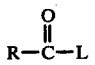

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 6 to about 13;

wherein the molar ratio of hydrogen peroxide yielded by (a) to bleach activator (b) is greater than about 1.5.

2. The composition of claim 1 wherein the molar ratio of hydrogen peroxide yielded by (a) to bleach activator (b) is at least about 2.0.

3. The composition of claim 1 wherein the peroxygen bleaching compound is selected from the group consisting of sodium perborate monohydrate, sodium perborate tetrahydrate, sodium carbonate peroxyhydrate, sodium pyrophosphate peroxyhydrate, urea peroxyhydrate, sodium peroxide and mixtures thereof.

4. The composition of claim 3 wherein the peroxygen bleaching compound is sodium perborate monohydrate.

5. The composition of claim 2 wherein L is a leaving group, the conjugate acid of which has a $pK_a$ in the range of from about 7 to about 11.

6. The composition of claim 5 wherein L is a leaving group, the conjugate acid of which has a $pK_a$ in the range of from about 8 to about 11.

7. The composition of claim 1 wherein L is selected from the group consisting of:

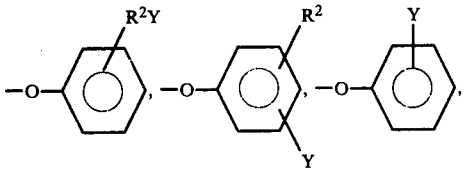

-continued

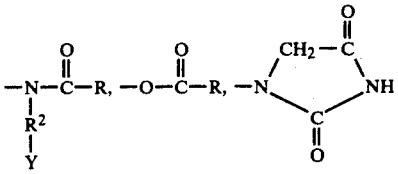

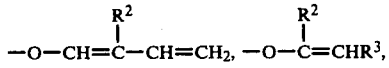

wherein R is as defined in claim 1, $R^2$ is an alkyl chain containing from about 1 to about 8 carbon atoms, $R^3$ is H or $R^2$, and Y is H or a solubilizing group.

8. The composition of claim 7 wherein Y is selected from the group consisting of: $-SO^-{}_3M^+$, $-COO^-M^+$, $-SO^-{}_4M^+$, $(-N^+R_3{}^4)X^-$ and $O\leftarrow NR_2{}^4$ and mixtures thereof wherein $R^4$ is an alkyl chain containing from about 1 to about 4 carbon atoms, M is a cation which provides solubility to the bleach activator and X is an anion which provides solubility to the bleach activator.

9. The composition of claim 8 wherein Y is selected from the group consisting of $-SO_3{}^{-M+}$, $-COO^-M^+$ and mixtures thereof wherein M is selected from the group consisting of sodium, potassium and mixtures thereof.

10. The composition of claim 7 wherein L is selected from the group consisting of:

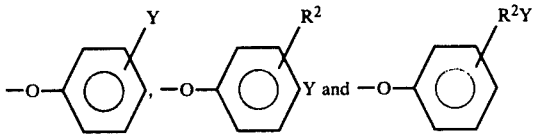

wherein $R^2$ is an alkyl chain containing from about 1 to about 8 carbon atoms, Y is $-SO_3{}^{-M+}$ or $-COO^-M^+$ wherein M is sodium or potassium.

11. The composition of claim 10 wherein L has the general formula:

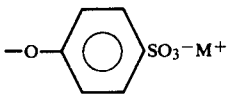

wherein M is sodium or potassium.

12. The composition of claim 2 wherein R is an alkyl group containing from about 5 to about 12 carbon atoms wherein the longest linear alkyl chain extending from and including the carbonyl carbon contains from about 6 to about 10 carbon atoms.

13. The composition of claim 12 wherein R is a linear alkyl chain containing from about 5 to about 9 carbon atoms.

14. The composition of claim 13 wherein R is a linear alkyl chain containing from about 6 to about 8 carbon atoms.

15. The compositions of claim 2 wherein R is an alkyl group containing from about 5 to about 12 carbon atoms wherein the longest linear alkyl chain extending from and including the carbonyl carbon contains from about 6 to about 10 carbon atoms and L is selected from the group consisting of:

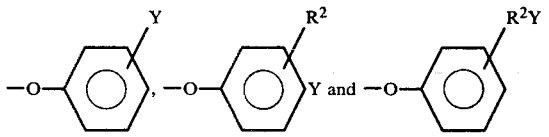

wherein $R^2$ is an alkyl chain containing from about 1 to about 8 carbon atoms, Y is $—SO_3^-M^+$ or $—COO^-M^+$ wherein M is sodium or potassium.

16. The composition of claim 15 wherein R is a linear alkyl chain containing from about 5 to about 9 carbon atoms.

17. The composition of claim 16 wherein R is a linear alkyl chain containing from about 6 to about 8 carbon atoms.

18. The composition of claim 2 wherein R is an alkyl group containing from about 5 to about 12 carbon atoms wherein the longest linear alkyl chain extending from and including the carbonyl carbon contains from about 6 to about 10 carbon atoms and L has the general formula

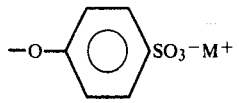

wherein M is sodium or potassium.

19. The composition of claim 18 wherein R is a linear alkyl chain containing from about 5 to about 9 carbon atoms.

20. The composition of claim 19 wherein R is a linear alkyl chain containing from about 6 to about 8 carbon atoms.

21. A bleaching composition comprising, by weight:

(a) from about 1% to about 60% of a peroxygen bleaching compound capable of yielding hydrogen peroxide in an aqueous solution;

(b) from about 0.5% to about 40% of a bleach activator having the general formula:

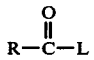

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 6 to about 13;

wherein the molar ratio of hydrogen peroxide yielded by (a) to bleach activator (b) is greater than about 1.5; and (c) from about 1% to about 30% of a detergent surfactant.

22. The composition of claim 21 further containing from about 10% to about 60% of a detergency builder.

* * * * *

UNITED STATES PATENT AND TRADEMARK OFFICE

CERTIFICATE OF CORRECTION

PATENT NO. : 4,412,934

DATED : November 1, 1983

INVENTOR(S) : Stanley Y. Chung

It is certified that error appears in the above-identified patent and that said Letters Patent is hereby corrected as shown below:

Column 14, lines 28 and 31, "V" should read -- VI --.

Signed and Sealed this

*Seventh* Day of *January 1986*

[SEAL]

*Attest:*

DONALD J. QUIGG

*Attesting Officer*

*Commissioner of Patents and Trademarks*